US009420659B2

(12) United States Patent
Shibata et al.

(10) Patent No.: US 9,420,659 B2
(45) Date of Patent: Aug. 16, 2016

(54) LED POWER SUPPLY DEVICE

(71) Applicant: Rohm Co., Ltd., Kyoto (JP)

(72) Inventors: Kotaro Shibata, Kyoto (JP); Akinobu Sawada, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 15/000,340

(22) Filed: Jan. 19, 2016

(65) Prior Publication Data

US 2016/0150613 A1 May 26, 2016

Related U.S. Application Data

(63) Continuation of application No. 14/499,972, filed on Sep. 29, 2014, now Pat. No. 9,271,365.

(30) Foreign Application Priority Data

Sep. 30, 2013 (JP) ..... 2013204639

(51) Int. Cl.
*H05B 37/02* (2006.01)
*H05B 33/08* (2006.01)

(52) U.S. Cl.
CPC ..... *H05B 33/0851* (2013.01)

(58) Field of Classification Search
CPC .... H05B 37/02; H05B 33/08; H05B 33/0815; H05B 33/0842; H05B 33/0848; H05B 33/0851
USPC ..... 315/209 R, 224, 225, 291, 294, 307, 315/308, 312
See application file for complete search history.

(56) References Cited

U.S. PATENT DOCUMENTS

| | | | | |
|---|---|---|---|---|
| 8,339,053 | B2 | 12/2012 | Yamasaki | |
| 2009/0322247 | A1* | 12/2009 | Goo | H05B 33/0818 315/291 |
| 2010/0219764 | A1 | 9/2010 | Yamasaki et al. | |
| 2011/0057576 | A1 | 3/2011 | Otake et al. | |

FOREIGN PATENT DOCUMENTS

| | | |
|---|---|---|
| JP | 2011-108668 | 6/2011 |
| JP | 2011-187205 | 9/2011 |

* cited by examiner

*Primary Examiner* — Jimmy Vu
(74) *Attorney, Agent, or Firm* — Fish & Richardson P.C.

(57) ABSTRACT

An LED power supply device disclosed in the present specification includes a DC dimmer circuit that performs dimming control of an LED such that the higher a reference voltage variably controlled according to a dimmer signal is, the smaller a current flowing in the LED is. This configuration makes it possible to achieve fine dimming control.

11 Claims, 21 Drawing Sheets

FIG.8

| Duty (%) | 0 | ··· | 87 | 88 | 89 | 90 | 100 |
|---|---|---|---|---|---|---|---|
| OUTPUT CURRENT (mA) | 1050 | ··· | 5 | 2 | 1 | 0 | 0 |
| RATIO TO MAX CURRENT (%) | 100 | ··· | 0.48 | 0.19 | 0.10 | 0.00 | 0.00 |

| sample No. | 1 | 2 | 3 |
|---|---|---|---|
| DUTY VALUE (%) 【OUTPUT CURRENT=0】 | 88 | 93 | 81 |

DUTY VALUE ABOUT ± 10%

FIG.11

| VDD(V) | 3.30 | 3.29 | 3.28 |
|---|---|---|---|
| Io(mA) | 1.1 | 8.4 | 17.4 |

| sample No. | 1 | 2 | 3 |
|---|---|---|---|
| DUTY VALUE (%) 【OUTPUT CURRENT=0】 | 88 | 87 | 90 |

DUTY VALUE ABOUT ± 3%

FIG.18

| | DEVELOPMENT TARGET | RESULT | JUDGMENT |
|---|---|---|---|
| DIMMING RATIO | 0.1%(MIN:1mA) | 0.1%(MIN:1mA) | ○ |
| POWER FACTOR | 0.9 OR HIGHER WITH AC 100-200 V | AC100V 0.99 | ○ |
| | | AC200V 0.95 | |
| EFFICIENCY | 80% OR HIGHER | 85.7% | ○ |
| NOISE TERMINAL VOLTAGE | TO CONFORM TO PSE | STANDARDS CLEARED | ○ |
| DISTURBANCE POWER | TO CONFORM TO PSE | STANDARDS CLEARED | ○ |

LED POWER SUPPLY DEVICE

This application is based on Japanese Patent Application No. 2013-204639 filed on Sep. 30, 2013, the contents of which are hereby incorporated by reference.

BACKGROUND OF THE INVENTION

1. Field of the Invention

The present invention relates to an LED (light emitting diode) power supply device equipped with a dimming function.

2. Description of Related Art

In recent years, LED power supply devices have been required not only to be energy saving but also to be capable of producing stylish illumination, and advanced dimming systems have been attracting increasing attention. It is easy to differentiate a good dimming function from a bad one, and thus, to make a product more attractive to consumers, it is necessary to achieve high-level dimming control.

As examples of the conventional technology related to the foregoing, JP-A-2011-108668 and JP-A-2011-187205 can be cited.

SUMMARY OF THE INVENTION

However, a minimum value of a dimming ratio (=a rate of a target output current to a maximum output current) that can be set by means of conventional LED power supply devices is about 5%. Thus, in comparison of dimming between an LED lighting apparatus and an incandescent light bulb, the LED lighting apparatus has a problem that it goes out more steeply than the incandescent light bulb when fully turned off, and dimming of the LED lighting apparatus is not smooth (see FIG. 21). Note that, in order to achieve dimming of an LED lighting apparatus that is similar to the dimming of an incandescent light bulb, a dimming ratio is required to be smaller (for example, about 0.1%) than is conventionally achieved.

Moreover, LED power supply devices have been required to have a high efficiency (for example, 80% or higher), a high power factor (for example, 0.9 or higher [AC 100-200 V]), and an increased maximum output current value (for example, 1050 mA), and to acquire the PSE (product safety electrical appliance and materials) mark, for example.

In view of the above described problems found by the inventor of the present application, an object of the invention disclosed in the present specification is to provide an LED power supply device capable of performing fine dimming control.

To achieve the above object, an LED power supply device disclosed herein includes a DC dimmer circuit that performs dimming control of an LED such that the higher a reference voltage variably controlled according to a dimming signal is, the smaller an output current flowing in the LED is.

Other features, components, steps, advantages, and characteristics of the present invention will be disclosed in the following detailed description of the best mode for carrying out the present invention and relevant attached drawings.

BRIEF DESCRIPTION OF THE DRAWINGS

FIG. 8 is a correlation table of duty, output current, and dimming ratio in the second configuration example;

FIG. 11 is a correlation table of power supply voltage and output current;

FIG. 18 is a specifications table of an LED power supply device;

DETAILED DESCRIPTION OF PREFERRED EMBODIMENTS

<Selection of Power Supply System>

Figure 1:
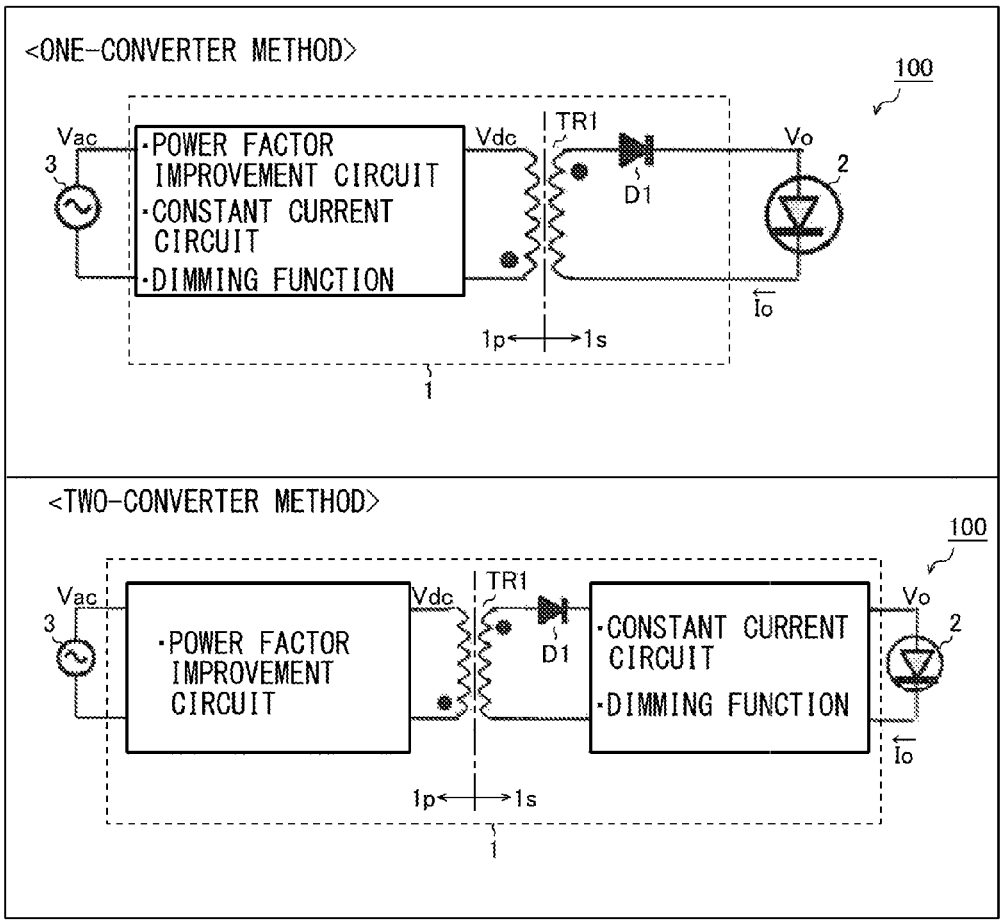
FIG. 1 is a comparison diagram for comparing a one-converter method with a two-converter method.

FIG. 1 is a comparison diagram for comparing a one-converter method with a two-converter method. An LED lighting apparatus 100 has an LED power supply device 1 and an LED 2 that is driven by receiving power supply from the LED power supply device 1. The LED power supply device 1 is a fly-back power supply device that generates an output voltage Vo from an input voltage Vdc, with a primary circuit system 1*p* and a secondary circuit system is insulated from each other by using a transformer TR1. The LED power supply device 1 is equipped also with an AC/DC conversion function to convert an AC voltage Vac supplied from a commercial AC power supply 3 into a DC input voltage Vdc.

In the one-converter method (see an upper section of the figure), a power factor improvement circuit, a constant current circuit, and a dimming function portion are all provided together in the primary circuit system 1*p*. Merits of the one-converter method include its high power supply efficiency and its low cost (a simple circuit configuration). On the other hand, demerits of the one-converter method include that dimming is difficult therewith.

In the two-converter method (see a lower section of the figure), the power factor improvement circuit is provided in the primary circuit system 1*p*, and the constant current circuit and the dimming function portion are provided in the secondary circuit system 1*s*. Merits of the two-converter method include that dimming is easy therewith. On the other hand, demerits of the one-converter method include its low power supply efficiency and its high cost (a complicated circuit configuration).

In view of these facts, it can be said that, for highly efficient dimming, the one-converter method should be selected to be adopted in the power supply system of the LED power supply device 1.

<Selection of Dimming Method>

Figure 2:
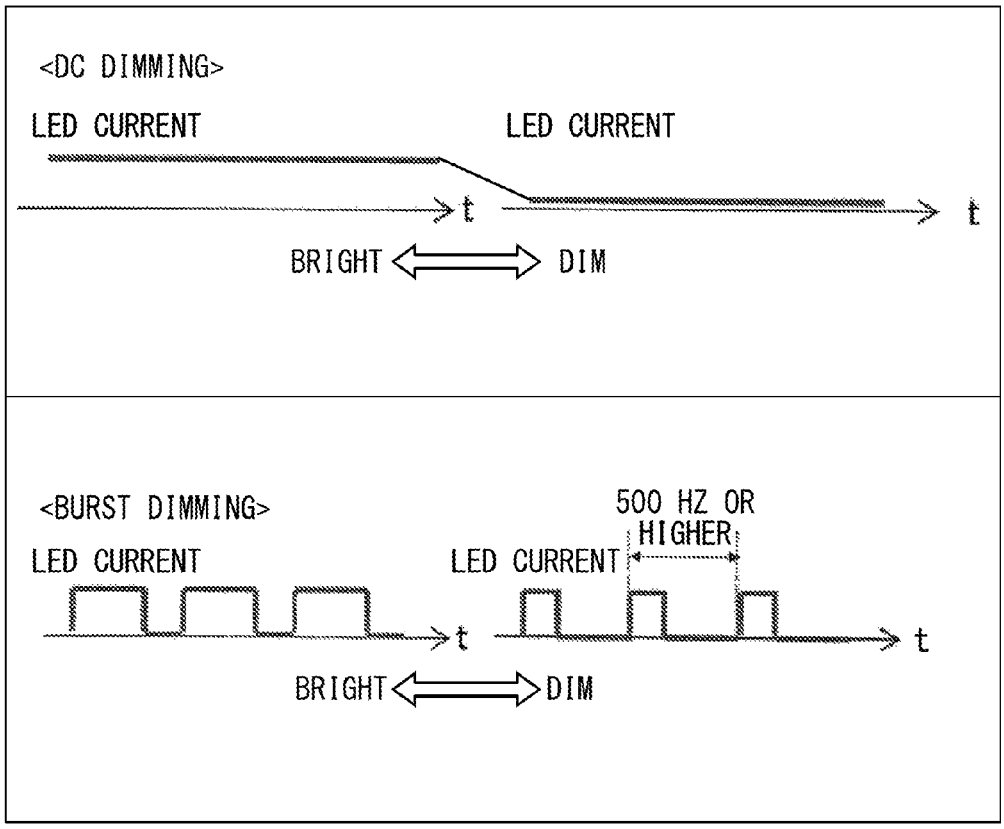
FIG. 2 is a comparison diagram for comparing DC dimming with burst dimming.

FIG. 2 is a comparison diagram for comparing DC dimming with burst dimming. In the DC dimming (see an upper section in the figure), dimming of the LED 2 is performed by increasing/decreasing a current value of an LED current (=an output current Io flowing in the LED 2). That is, when the current value of the LED current is large, the LED 2 becomes bright, and when the current value of the LED current is small, the LED 2 becomes dim. Merits of the DC dimming include that it generates no noise. On the other hand, demerits of the DC dimming include that it makes fine dimming difficult.

In the burst dimming (see a lower section in the figure), by periodically turning on/off an LED current having a constant current value to increase/decrease a time average of the LED current, and thereby the dimming of the LED 2 is performed. That is, when an on-duty (rate of ON time in a cycle) of the LED current is large, the LED 2 becomes bright, and when the on-duty of the LED current is small, the LED 2 becomes dim. Merits of the burst dimming include that it makes fine dimming control easy. On the other hand, demerits of the burst dimming include that it generates a stroboscopic effect and noise, and existence of the PSE standard.

In view of these facts, it can be said that, for higher versatility, as the dimming method for LED power supply devices, it is desirable to select the DC dimming which has fewer demerits.

<LED Power Supply Device>

Figure 3:
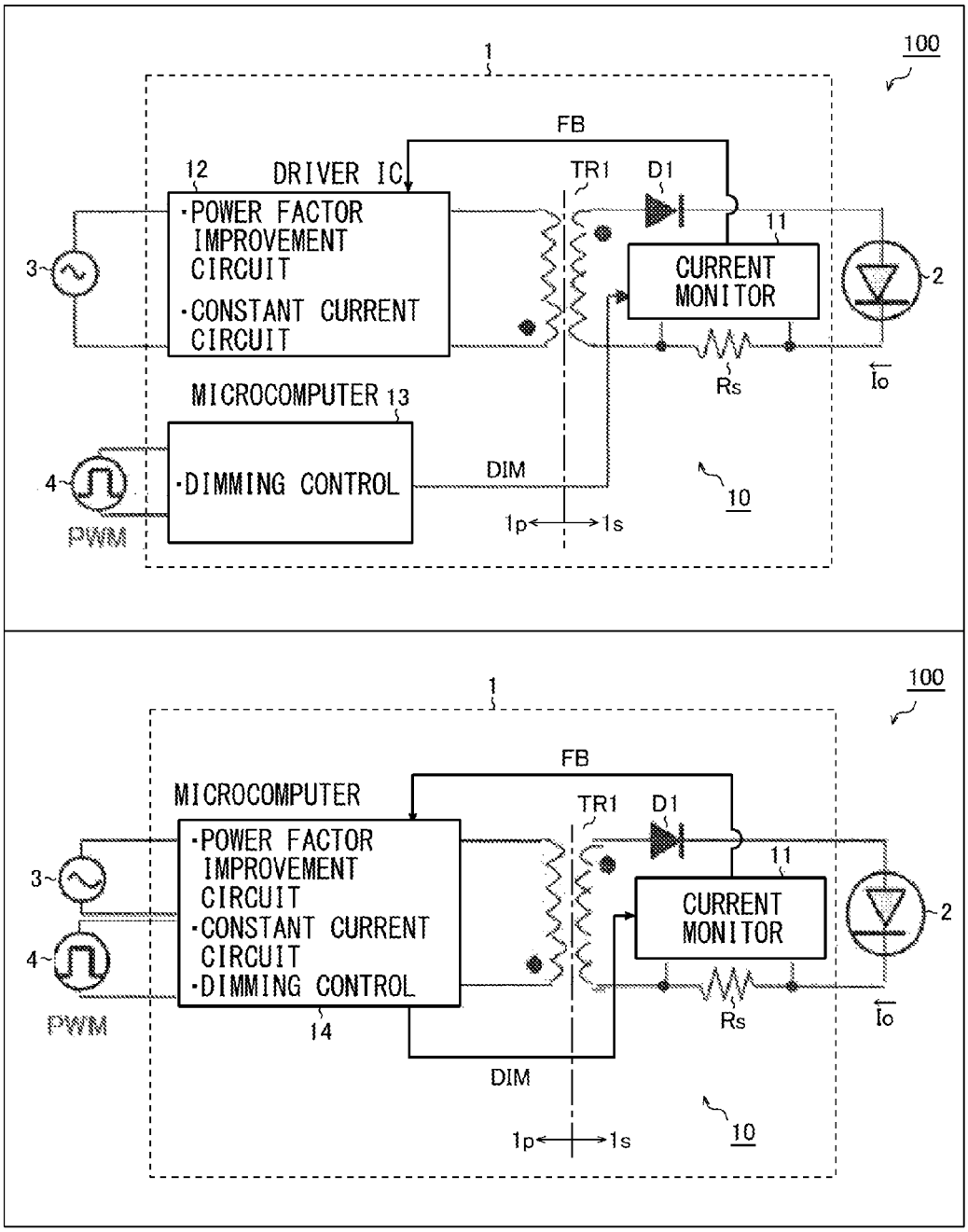
FIG. 3 is a block diagram showing a schematic configuration of an LED power supply device.

FIG. 3 is a block diagram showing a schematic configuration of the LED power supply device 1. The LED power supply device 1 has a DC dimmer circuit 10 as means for performing DC dimming of the LED 2. As shown in an upper section of the figure, the DC dimmer circuit 10 includes a current monitor 11 that monitors the output current Io flowing in a sense resistor Rs to generate a feedback signal FB, a driver IC 12 that performs constant current control of the output current Io according to the feedback signal FB, and a microcomputer 13 that performs PWM (pulse width modulation) driving of a dimming signal DIM by using a PWM signal source 4, and sends out the dimming signal DIM to the current monitor 11.

In the one-converter LED power supply device 1, the driver IC 12 and the microcomputer 13 are both provided in the primary circuit system 1*p*, and the current monitor 11 alone is provided in the secondary circuit system 1*s*.

As shown in a lower section of the figure, it is also possible to use a microcomputer 14 where the driver IC 12 and the microcomputer 13 are integrated to achieve integrated digital control of power supply and dimming. Adoption of these configurations makes it possible not only to enhance ability to respond to users' needs regarding the power supply specifications but also to reduce the number of components and cost.

Current Monitor

First Configuration Example

Figure 4:
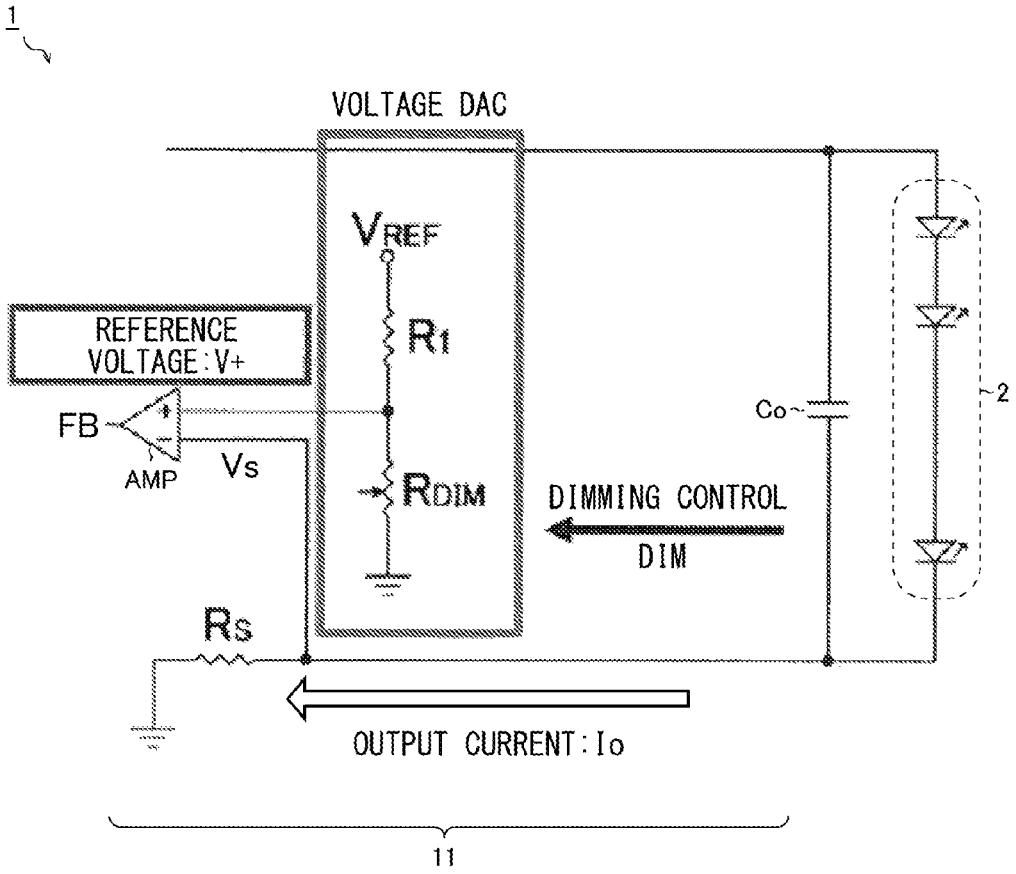
FIG. 4 is a circuit diagram showing a first configuration example of a current monitor.

FIG. 4 is a circuit diagram showing a first configuration example of the current monitor 11. The current monitor 11 of the present configuration example includes a sense resistor Rs, resistors R1 and RDIM, and an operational amplifier AMP. The resistors R1 and RDIM are connected in series between an internal power supply terminal (VREF) and a ground terminal, and a reference voltage V+(={RDIM/(R1+RDIM)}×VREF) is output from a connection node between the two resistors. Resistance of the resistor RDIM is variably controlled according to the dimming signal DIM. At a high-potential terminal of the sense resistor Rs, there appears a detection voltage Vs (=Io×Rs) in accordance with the output current Io. The operational amplifier AMP amplifies a difference between the reference voltage V+ applied to its non-inverting input terminal (+) and the detection voltage Vs applied to its inverting input terminal (−) to generate the feedback signal FB.

On receiving the input of the feedback signal FB, the driver IC 12 (not shown in FIG. 4) performs dimming control of the output current Io (on/off control of an output switch that is connected to a primary coil of the transformer TR1) such that the feedback signal FB becomes small. As a result, in the DC dimmer circuit 10, an output feedback is applied such that the reference voltage V+ and the detection voltage Vs are equal to each other (imaginary short), and thus the output current Io is matched to a target value (=V+/Rs) in accordance with the reference voltage V+.

Figure 5:
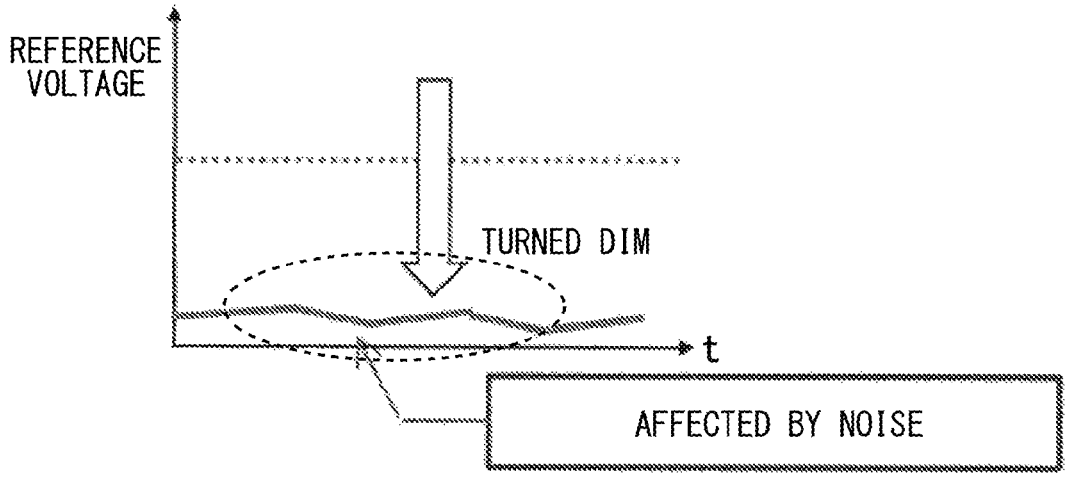
FIG. 5 is a waveform diagram showing a behavior of a reference voltage in the first configuration example.

Here, in the DC dimmer circuit 10 using the current monitor 11 of the first configuration example, dimming is performed by means of voltage control, and the output current Io becomes smaller according as the reference voltage V+ is lowered. However, a lower reference voltage V+ invites increased liability to be influenced by noise, and this makes it difficult to set the dimming ratio to a small value (see FIG. 5).

For example, when VREF=1.2V, R1=1 kΩ, and RDIM=1 kΩ (max), if RDIM is reduced to 1% (=10Ω), the reference voltage V+ falls to 12 mV and becomes more liable to be influenced by noise, and accordingly, flickers occur in the LED 2. Thus, it can be said that, with the DC dimmer circuit 10 using the current monitor 11 of the first configuration example, it is difficult to perform fine dimming control.

Current Monitor

Second Configuration Example

Figure 6:
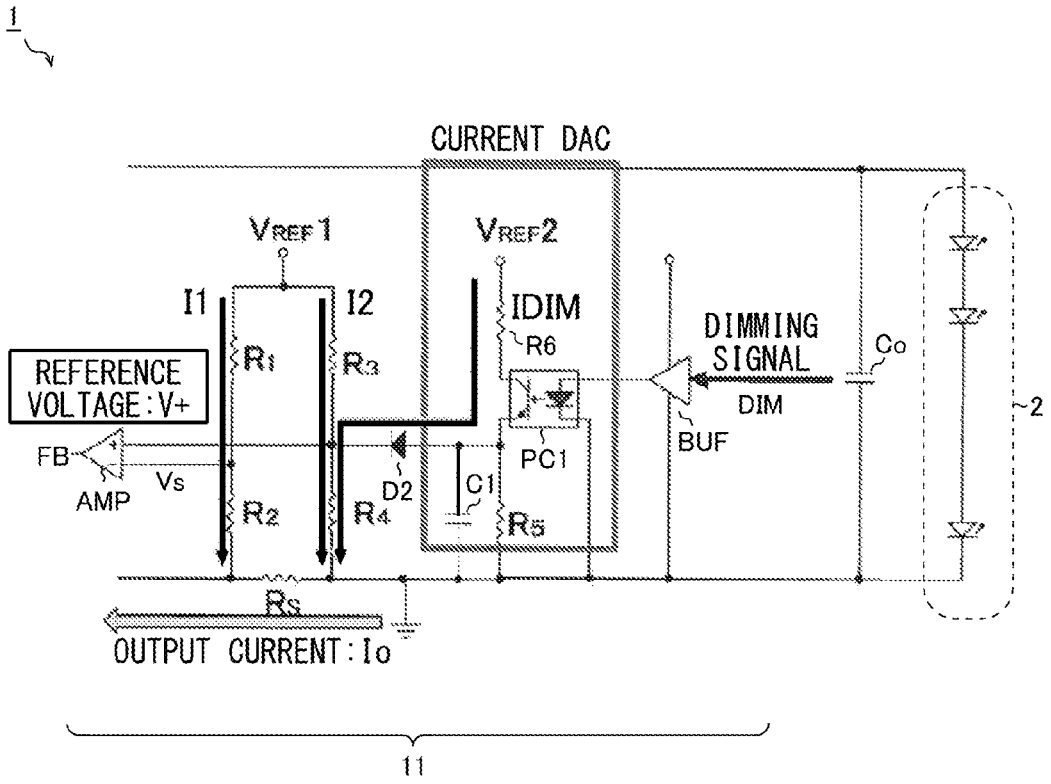
FIG. 6 is a circuit diagram showing a second configuration example of the current monitor.

FIG. 6 is a circuit diagram showing a second configuration example of the current monitor 11. The current monitor 11 of the present configuration example includes a sense resistor Rs, resistors R1-R6, a photo coupler PC1, a capacitor C1, a diode D2, a buffer BUF, and an operational amplifier AMP.

An anode of a photo diode that forms the photo coupler PC1 is connected to an output terminal of the buffer BUF. A cathode of the photo diode is connected to a ground terminal. A collector of a photo-transistor that forms the photo coupler PC1 is connected via the resistor R6 to a second internal power supply terminal (=VREF2). An emitter of the photo-transistor is connected to an anode of the diode D2, a first terminal of the resistor R5, and to a first terminal of the capacitor C1. Second terminals of the resistor R5 and the capacitor C1 are both connected to the ground terminal.

The photo coupler PC1 performs current output in accordance with the dimming signal DIM input thereto from the microcomputer 13 via the buffer BUF. The capacitor C1 smooths the current output form the photo coupler PC1 to generate a dimming current IDIM. That is, in the current monitor 11 of the present configuration example, the photo coupler PC1, the capacitor C1, and the resistors R5 and R6 function as a current DAC (digital to analog converter) that converts the dimming signal DIM which is PWM driven into the dimming current IDIM which is an analog current.

The sense resistor Rs is provided on a path through which the output current Io flows. The resistors R1 and R2 are connected in series between a first internal power supply terminal (=VREF1) and a low-potential terminal (=−Io×Rs) of the sense resistor Rs, and a current I1 flows through the resistors R1 an R2 via the path. As a result, at a connection node between the resistors R1 and R2, there appears a detection voltage Vs (=I1×R2−Io×Rs) in accordance with the output current Io. That is, in the current monitor 11 of the present configuration example, the sense resistor Rs and the resistors R1 and R2 function as a detection voltage generation portion that generates the detection voltage Vs according to the output current Io. Here, the smaller the output current Io is, the higher a voltage value of the detection voltage Vs becomes, and the larger the output current Io is, the lower the voltage value of the detection voltage Vs becomes.

The resistors R3 and R4 are connected in series between the first internal power supply terminal and a high-potential terminal (=GND) of the sense resistor Rs, and a current I2 flows in the resistors R3 an R4 via the path. Moreover, the connection node between the resistor R3 and the resistor R4 is connected also to a cathode of the diode D2 (corresponding to an output terminal of the current DAC), and, in the resistor R4, there flows a sum current (=I2+IDIM) that is obtained by adding the current I2 to the dimming current IDIM. As a result, at the connection node between the resistor R3 and the resistor R4, there appears a reference voltage V+(=(I2+IDIM)×R4) in accordance with the dimming current IDIM. That is, in the current monitor 11 of the present configuration example, the resistors R3 and R4 function as a reference voltage generation portion that generates the reference voltage V+ according to the dimming current IDIM.

As in the above-described first configuration example, the operational amplifier AMP amplifies a difference between the reference voltage V+ applied to its non-inverting input terminal (+) and the detection voltage Vs applied to its inverting input terminal (−) to generate a feedback signal FB.

Furthermore, as in the above-described first configuration example, on receiving input of the feedback signal FB, the driver IC 12 (not shown in FIG. 6) performs dimming control of the output current Io such that the feedback signal FB becomes small. As a result, in the DC dimmer circuit 10, an output feedback is applied such that the reference voltage V+ and the detection voltage Vs are equal to each other (imaginary short), and thus the output current Io is matched to a target value (=(I1×R2−V+)/Rs) in accordance with the reference voltage V+.

An important point here is that the dimming control of the LED 2 is performed not such that the lower the reference voltage V+ variably controlled according to the dimming signal DIM is, the smaller the output current Io becomes, but such that the higher the reference voltage V+ is, the smaller the output current Io becomes.

Figure 7:
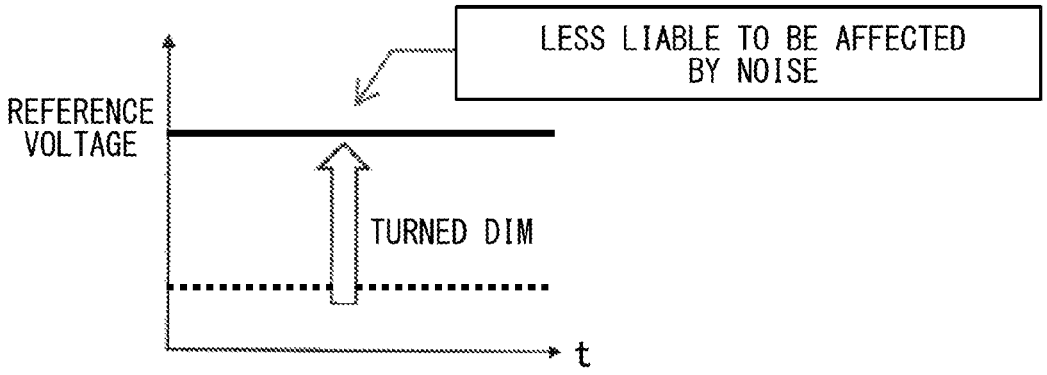
FIG. 7 is a waveform diagram showing a behavior of the reference voltage in the second configuration example.
Figure 9:
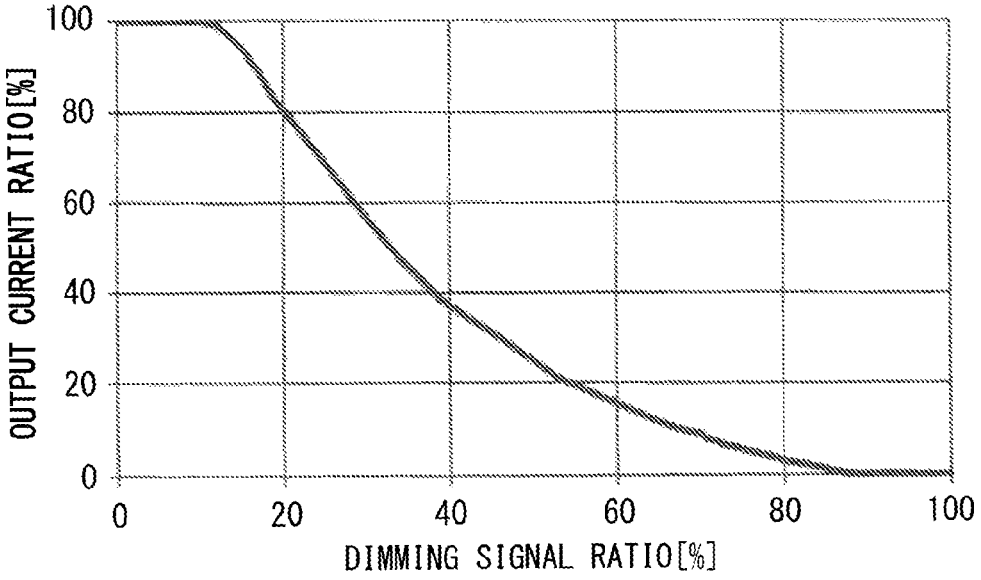
FIG. 9 is a correlation diagram of dimming signal ratio and output current ratio in the second configuration example.

Thus, in the DC dimmer circuit 10 using the current monitor 11 of the second configuration example, dimming is performed by means of current control using the photo coupler PC1, and the output current Io becomes smaller according as the reference voltage V+ is raised. Consequently, even when the dimming ratio is set small, the reference voltage V+ becomes less liable to be influenced by noise (see FIG. 7). As a result, in comparison with the above-described first configuration example, it is possible to achieve a very fine dimming (with a dimming ratio of 0.1%, for example) (see FIG. 8 and FIG. 9).

Figure 10:
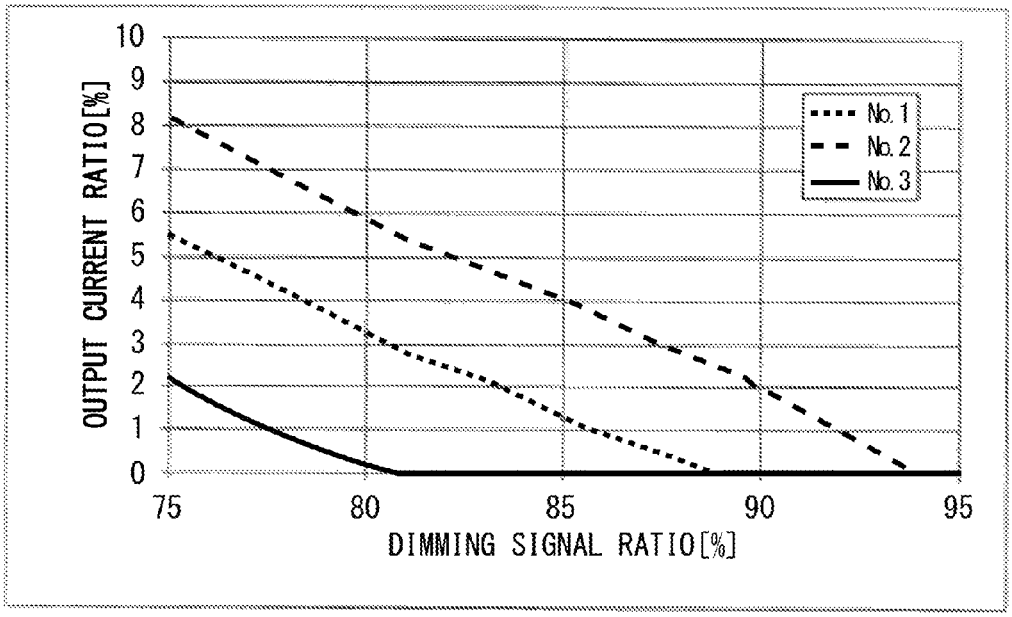
FIG. 10 is a correlation diagram of dimming signal ratio and output current ratio in each of a plurality of products.

<Software Trimming>

Where the current monitor 11 of the second configuration example is used, there may be a trade-off such that it is possible to achieve a dimming ratio of 0.1%, but on the other hand, due to the introduction of the buffer BUF and the photo coupler PC1, the dimming signal ratio (duty value) when the output current Io is at a zero value varies from product to product (see FIG. 10).

Figure 12:
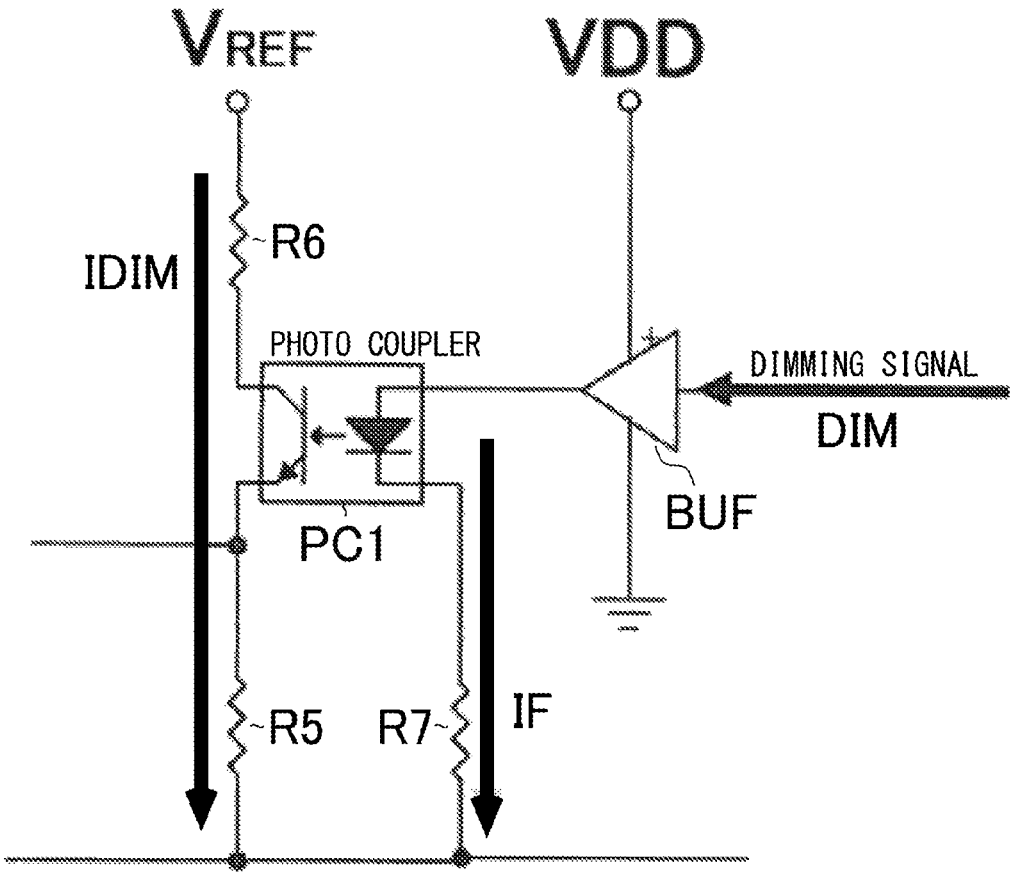
FIG. 12 is a circuit diagram for illustrating CTR variation of a photo coupler.

A first factor responsible for the trade-off is variation in a power supply voltage VDD supplied to the buffer BUF. If the power supply voltage VDD varies, the pulse peak value of the dimming signal DIM transmitted to the photo coupler PC1 from the buffer BUF varies and a forward current IF of the photo coupler PC1 also varies, and this in turn causes variation in the dimming current IDIM, and furthermore, the output current Io is caused to greatly vary in value. For example, if the power supply voltage VDD varies by 10 mV (0.3%), it causes the output current Io to vary by about 7 mA (see FIG. 11 and FIG. 12). A second factor is the variation in a current transfer ratio (CTR (=IDIM/IF×100)) that the photo coupler PC1 has. The CTR of the photo coupler PC1 generally has a wide range of variation (50% to 300%), and thus the current value of the output current Io also has a wide range of variation.

Unfortunately, however, it is difficult to eliminate these factors by taking measures in terms of hardware. Thus, here, variation in dimming (±10%), which cannot be eliminated by taking measures in terms of hardware, is eliminated by software trimming by using the microcomputer 13.

Figure 13:
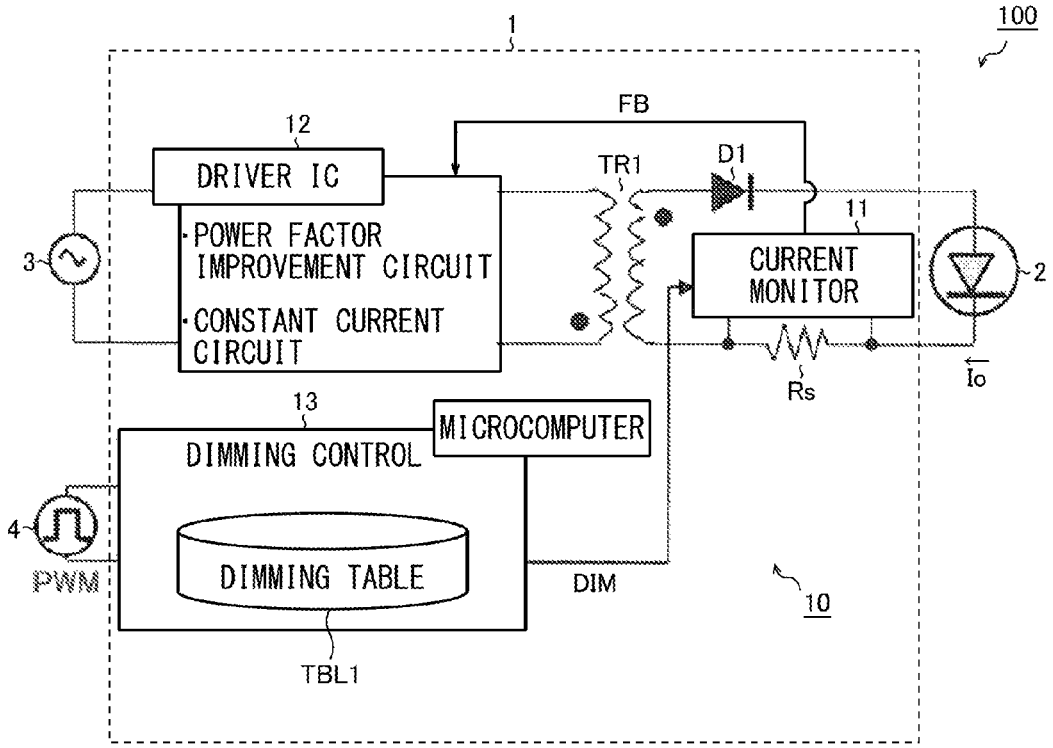
FIG. 13 is a block diagram showing an LED power supply device equipped with a software trimming function.

FIG. 13 is a block diagram showing the LED power supply device 1 equipped with a software trimming function. The microcomputer 13 generates the dimming signal DIM using a dimming table TBL1 that defines correlation between dimming signal ratio and output current ratio.

Figure 14:
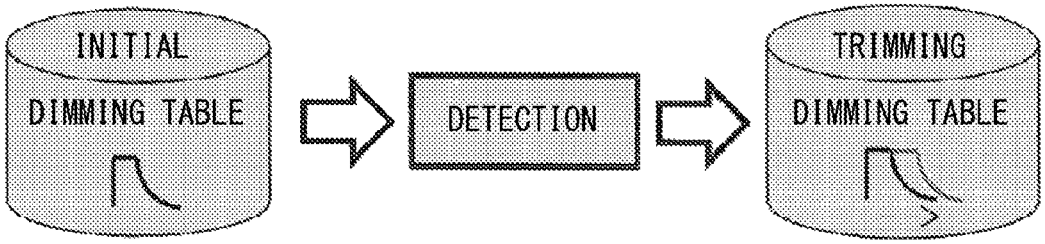
FIG. 14 is a schematic diagram showing an example of a flow of trimming.
Figure 15:
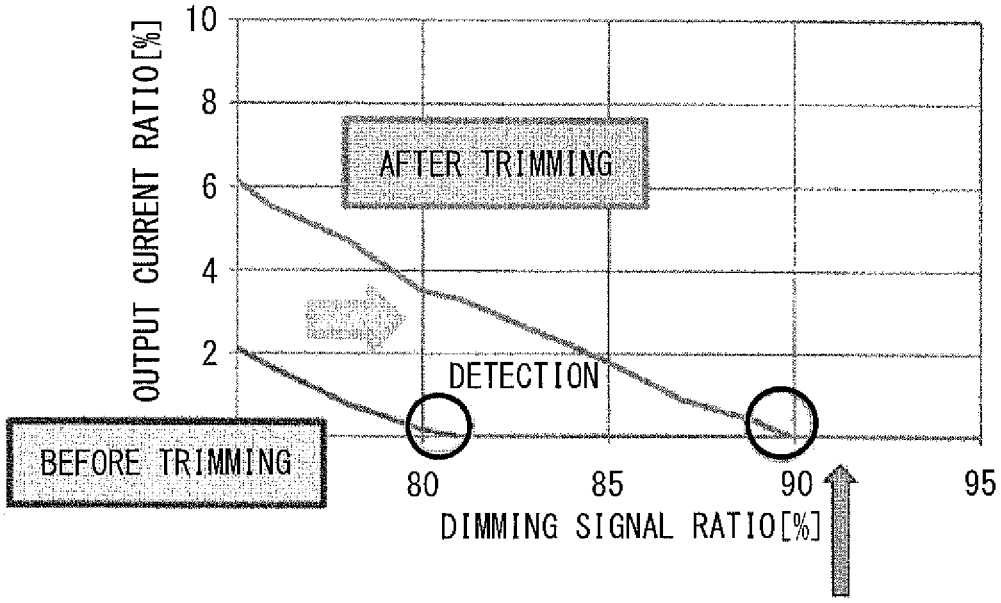
FIG. 15 is a correlation diagram of dimming signal ratio and output current ratio before and after trimming.

In doing so, the microcomputer 13 detects, by using an initial version of the dimming table, a dimming signal ratio when the output current ratio is zero, and then corrects the dimming table TBL1 such that the detected value is equal to a target value (see FIG. 14 and FIG. 15).

Figure 16:
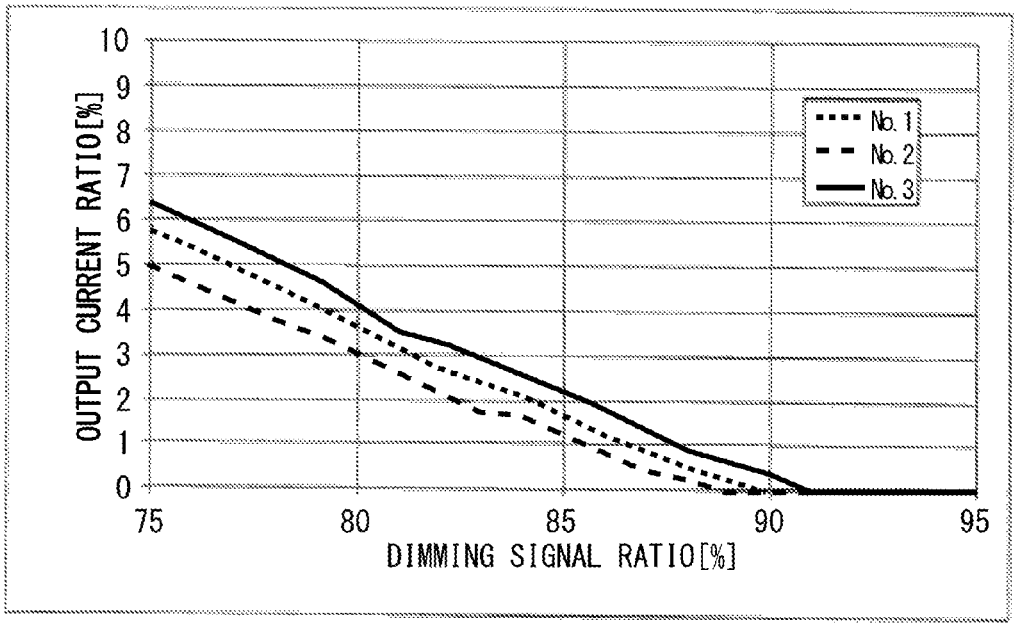
FIG. 16 is a correlation diagram of dimming signal ratio and output current ratio after trimming in each of a plurality of products.

Through such software trimming, it is possible to match the dimming signal ratio when the output current Io is at a zero value to the target value (90%, for example) with respect to all products, and this makes it possible to significantly reduce the variation in dimming (±10%→±3%) (see FIG. 16)

For example, when a plurality of LED light sources are turned on simultaneously, the LED light sources actually start to shine at different timings before the software trimming, and this makes them look awkward in comparison with incandescent light bulbs. On the other hand, after the software trimming, the timings at which the LED light sources start to shine are almost the same, and this allows the LED light sources to demonstrate a behavior similar to that of incandescent light bulbs. An LED lighting apparatus using these LED light sources are the most suitable as a substitute for a large number of incandescent light bulbs provided for stage effects in a large hall.

Conclusion

Figure 17:
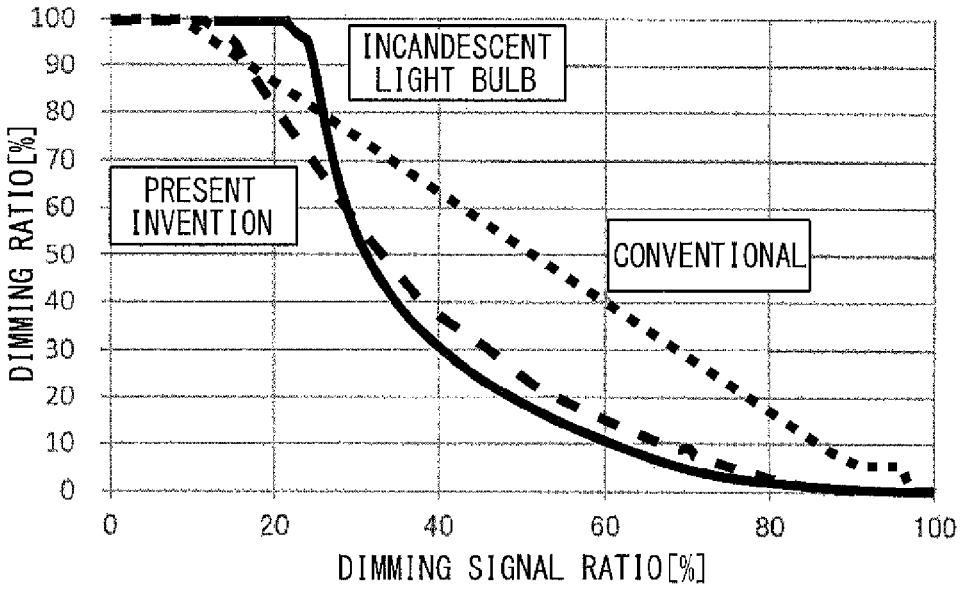
FIG. 17 is a comparison diagram for comparing behaviors of an LED lighting apparatus and an incandescent light bulb.

Adoption of the above configurations makes it possible to achieve dimming that is smoother than conventionally performed dimming and that is close to dimming performed with incandescent light bulbs (see FIG. 17). Moreover, it is possible to achieve performance excellent in all of the following: dimming ratio, power factor, efficiency, noise terminal voltage, and disturbance power (see FIG. 18).

<Detailed Configuration>

Figure 19:
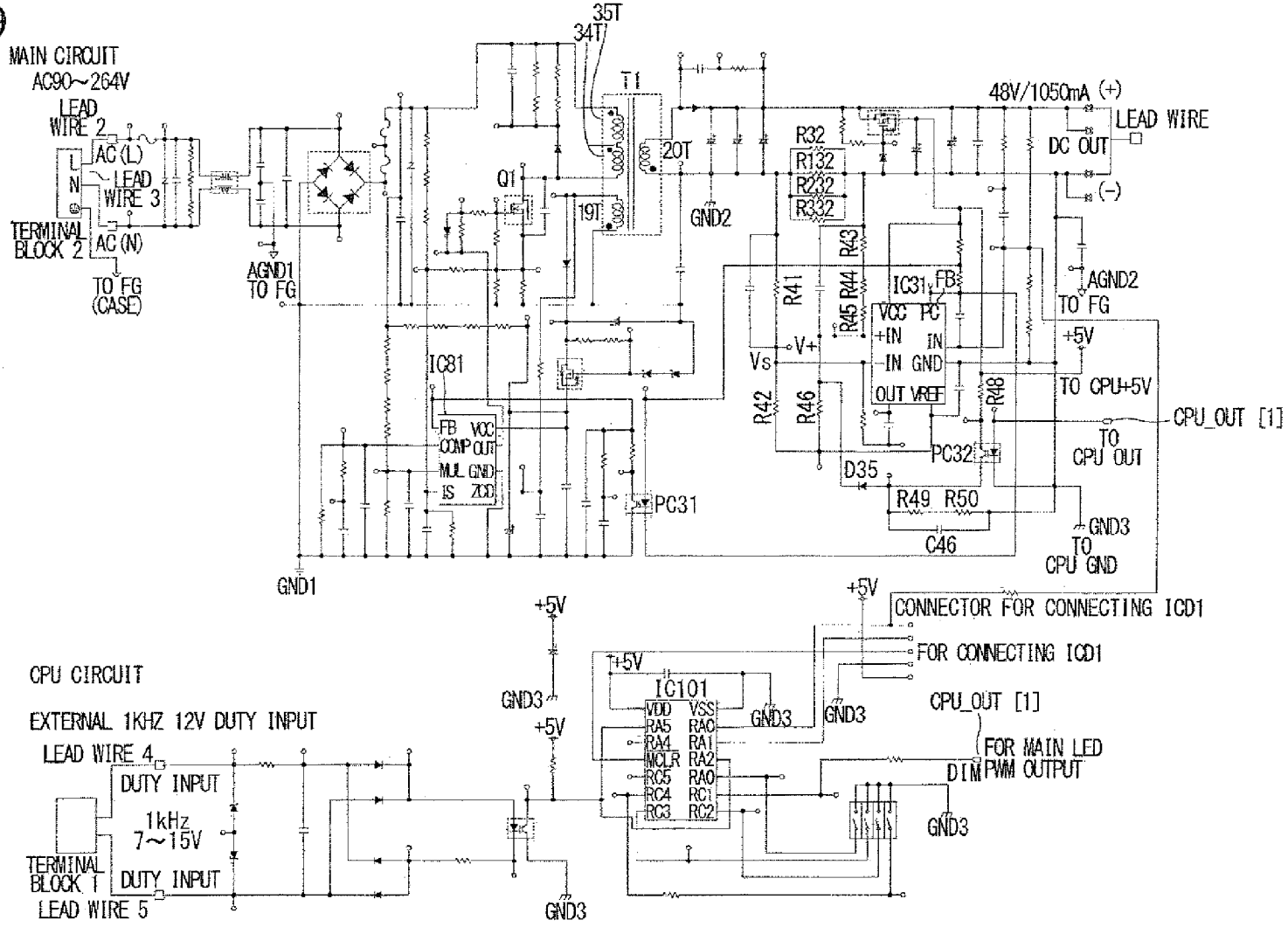
FIG. 19 is a circuit diagram showing a detailed configuration (a first example) of an LED power supply device.

FIG. 19 is a circuit diagram showing a detailed configuration (a first example) of the LED power supply device 1. Here, detailed descriptions will be given focusing mainly on the portion corresponding to the current monitor 11 of the second configuration example (see FIG. 6). Among the various circuit elements illustrated in the present figure, IC31, R41-R46, and R48-R50, R32, R132, R232, R332, C46, D35 and PC32 correspond to the circuit elements that form the current monitor 11 of the second configuration example.

Specifically, IC31 in FIG. 19 corresponds to the operational amplifier AMP in FIG. 6. A resistor R42 in FIG. 19 corresponds to the resistor R1 in FIG. 6. A resistor R41 in FIG. 19 corresponds to the resistor R2 in FIG. 6. Resistor R46 in FIG. 19 corresponds to the resistor R3 in FIG. 6. Resistors R43-R45 in FIG. 19 correspond to the resistor R4 in FIG. 6. Resistors R49 and R50 in FIG. 19 correspond to the resistor R5 in FIG. 6. A resistor R48 in FIG. 19 corresponds to the resistor R6 in FIG. 6. A photo coupler PC32 in FIG. 19 corresponds to the photo coupler PC1 in FIG. 6. A resistor R32, a resistor R132, a resistor R232, and a resistor 332 in FIG. 19 correspond to the sense resistor Rs in FIG. 6. A capacitor C46 in FIG. 19 corresponds to the capacitor C1 in FIG. 6. A diode D35 in FIG. 19 corresponds to the diode D2 in FIG. 6.

The dimming signal DIM output from an RC1 pin of IC101 (the microcomputer 13) is input to the photo coupler PC32. The feedback signal FB output from a PC pin of IC31 (the operational amplifier AMP) is input to an FB pin of IC81 (corresponding to the driver IC 12) via the photo coupler PC31. IC81 outputs a gate signal from its OUT pin according to the feedback signal FB, and thereby performs on/off control of an output switch Q1 connected to primary coils 34T and 35T of a transformer T1 (corresponding to the transformer TR1).

Figure 20:
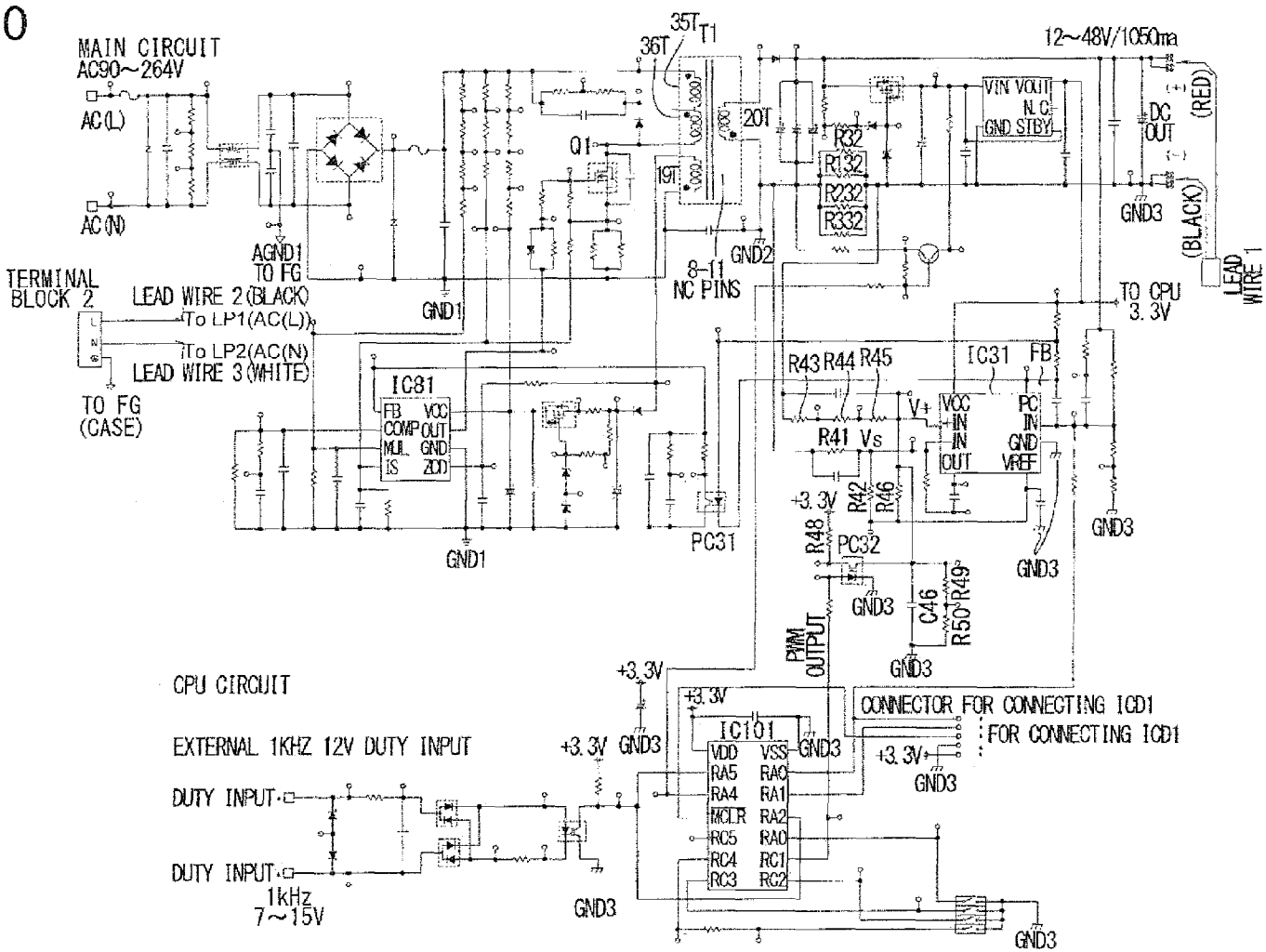
FIG. 20 is a circuit diagram showing a detailed configuration (a second example) of an LED power supply device.
Figure 21:
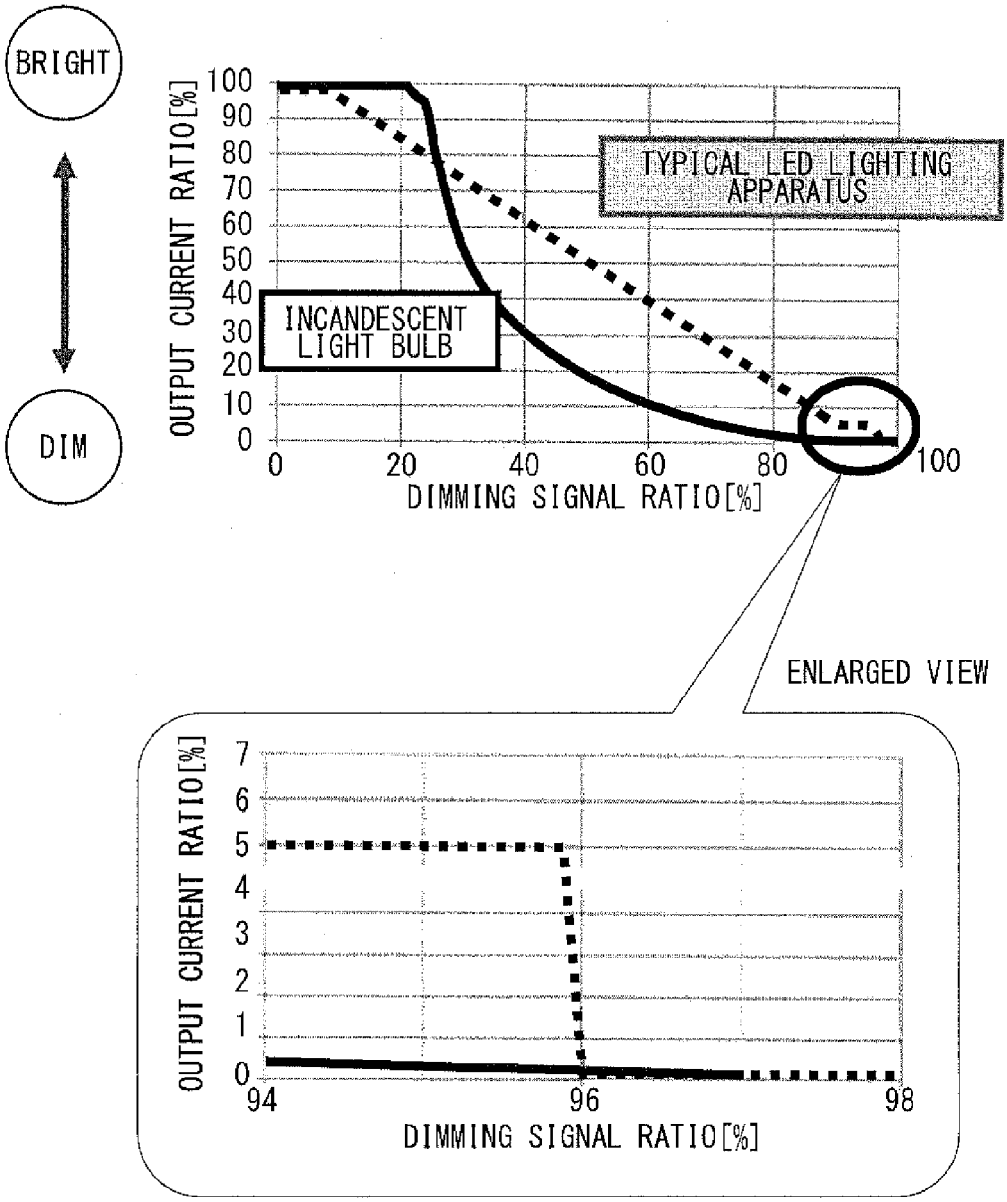
FIG. 21 is a comparison diagram for comparing a behavior of a conventional LED lighting apparatus with a behavior of an incandescent light bulb.

FIG. 20 is a circuit diagram showing a detailed configuration (a second example) of the LED power supply device 1. The circuit configuration of the second example, which is basically the same as the above first example, is different from the first example in some points, one of which is that the diode D35 (the diode D2 in FIG. 6) for reverse current prevention connected to the output terminal of current DAC is omitted in the second example.

With this configuration, it is possible to eliminate variation in dimming resulting from variation in components of the diode D35.

Other Modified Examples

In addition to the above embodiments, it is possible to add various modifications to the various technical features disclosed in the present specification without departing the spirit of the technological creation. In other words, it should be understood that the above embodiments are examples in all respects and are not limiting; the technological scope of the present invention is not indicated by the above description of the embodiments but by the claims; and all modifications within the scope of the claims and the meaning equivalent to the claims are covered.

INDUSTRIAL APPLICABILITY

The invention disclosed herein is applicable to, for example, lighting equipment for use in facilities where the dimming function is required for saving energy and lighting equipment for household use where sophisticated dimming is required.

What is claimed is:

1. An LED lighting device comprising:

LED;

a detection voltage generation portion that generates a detection voltage according to an output current flowing in the LED;

a reference voltage generation portion that generates a reference voltage according to a dimming signal input from the outside of the LED lighting device for adjusting the brightness of the LED;

an amplifier that generates a feedback signal according to a difference between the detection voltage and the reference voltage; and a driver that adjusts the output current according to the feedback signal, wherein the higher the brightness of the LED according to the dimming signal is, the lower the reference voltage becomes, and the lower the brightness of the LED according to the dimming signal is, the higher the reference voltage becomes.

2. The LED lighting device of claim 1, wherein the driver adjusts the output current such that the feedback signal becomes small.

3. The LED lighting device of claim 1, wherein the smaller the output current is, the higher the detection voltage becomes, and the bigger the output current is, the lower the detection voltage becomes.

4. The LED lighting device of claim 3, wherein the detection voltage generation portion includes:

a sense resistor provided on a path through which the output current flows; and first and second resistors connected in series between an internal power supply terminal and a low-potential terminal of the sense resistor, wherein the detection voltage is output from a connection node between the first and second resistors.

5. The LED lighting device of claim 4, wherein the reference voltage generation portion includes third and fourth resistors connected in series between the internal power supply terminal and a high-potential terminal of the sense resistor, wherein a dimming current according to the dimming signal is applied to a connection node between the third and fourth resistors is connected such that the reference voltage is output from the connection node.

6. The LED lighting device of claim 5, further comprising:

a microcomputer that generates the dimming signal.

7. The LED lighting device of claim 6, wherein the microcomputer generates the dimming signal by using a dimming table which defines correlation between dimming signal ratio and output current ratio.

8. The LED lighting device of claim 6, further comprising:

a current DAC that converts the dimming signal which is PWM-driven by the microcomputer into the dimming current having an analog value.

9. The LED lighting device of claim 8, wherein the driver and the microcomputer are provided in a primary circuit system, and the LED, the detection voltage generation portion, the reference voltage generation portion, the amplifier, and the current DAC are provided in a secondary circuit system insulated from the primary circuit system.

10. The LED lighting device of claim 9, wherein the current DAC includes:

a photo coupler that receives input of the dimming signal from the microcomputer; and a capacitor that smooths output from the photo coupler to generate the dimming current.

11. An LED driving circuit comprising:

a reference voltage generation portion that generates a reference voltage according to a dimming signal input from the outside of the LED driving circuit for adjusting the brightness of an LED;

an amplifier that generates a feedback signal according to a difference between a detection voltage and the reference voltage, the detection voltage generated according to an output current flowing in the LED; and a driver that adjusts the output current according to the feedback signal, wherein the higher the brightness of the LED according to the dimming signal is, the lower the reference voltage becomes, and the lower the brightness of the LED according to the dimming signal is, the higher the reference voltage becomes.

* * * * *